US007424211B2

(12) United States Patent
Lehmann

(10) Patent No.: US 7,424,211 B2
(45) Date of Patent: Sep. 9, 2008

(54) MEANS FOR INFLUENCING THE TEMPERATURE OF FLOWABLE MEDIA, ESPECIALLY OF LUBRICANTS FOUND IN A LUBRICANT SYSTEM

(75) Inventor: Frank Günter Lehmann, Spiesen-Elversberg (DE)

(73) Assignee: Hydac System GmbH, Sulzbach/Saar (DE)

( * ) Notice: Subject to any disclaimer, the term of this patent is extended or adjusted under 35 U.S.C. 154(b) by 107 days.

(21) Appl. No.: 11/401,481

(22) Filed: Apr. 11, 2006

(65) Prior Publication Data

US 2007/0237497 A1 Oct. 11, 2007

(30) Foreign Application Priority Data

Apr. 4, 2006 (DE) ..... 10 2006 015 601

(51) Int. Cl.
*H05B 3/60* (2006.01)
*H05B 3/78* (2006.01)

(52) U.S. Cl. ..... 392/314; 392/485

(58) Field of Classification Search ..... 392/311–338, 392/479–497
See application file for complete search history.

(56) References Cited

U.S. PATENT DOCUMENTS 2,457,596 A * 12/1948 Osterheld ..... 392/497
2,933,708 A * 4/1960 Elliot et al. ..... 338/28
4,972,067 A * 11/1990 Lokar et al. ..... 219/505

* cited by examiner

*Primary Examiner*—Sang Y Paik
(74) *Attorney, Agent, or Firm*—Roylance, Abrams, Berdo & Goodman, L.L.P.

(57) ABSTRACT

An arrangement for influencing the temperature of flowable media, especially of lubricants found in a lubricant system, has a line through which the medium flow. At least one element (11) is assigned to the line section (1, 5) for influencing the temperature, and can be activated by supplying energy. At least one element (11) is located within the line section (1, 5) in the flow path of the medium. The wall in the line section (1,5) has a connection means (9) for supplying energy to the element (11) located in the line section (1, 5).

12 Claims, 3 Drawing Sheets

MEANS FOR INFLUENCING THE TEMPERATURE OF FLOWABLE MEDIA, ESPECIALLY OF LUBRICANTS FOUND IN A LUBRICANT SYSTEM

FIELD OF THE INVENTION

The present invention relates to a means for influencing the temperature of flowable media, especially of lubricants in a lubricant system, having a line through which the medium flows and at least one element which is assigned to the line section for influencing the temperature and which can be activated by supplying energy.

BACKGROUND OF THE INVENTION

Means of this type can be used for example in mechanical systems, especially in large machines, when operating states for flowable operating media, for example lubricating oils, are expected to have temperatures leading to an unfavorable operating behavior, specifically an overly great viscosity. These operating states, as can occur during cold running phases of certain systems or specifically in wind power plants under winter conditions, make it difficult to transport the operating media, for example the lubricant circulation. For this reason, on a certain line section, for example on the lubricant line leading from a mechanism via a pump and via filter means and the like back to the mechanism, there are conventionally means with elements for increasing or also reducing the temperature of the flowing media.

Known means of this type are made such that on the indicated line section one or more elements (heating elements and/or cooling elements) for influencing the temperature are attached on the outside wall and can be activated as necessary. To achieve a sufficient action for the medium located within the line section, external insulation must encompass the line section and lie over the elements to prevent excess losses to the outside. In spite of insulating outside jacketing, sufficient efficiency is not achieved when the temperature of the inner medium is influenced. The external insulation jacketing leads to an awkwardly shaped outside contour of the line section, requiring a large amount of space so that installation in mechanical systems under narrowed installation conditions becomes very difficult. Efficiency is especially low when the elements are attached to a nonmetallic line section, for example to an oil intake tube via which lubricating oil from the mechanism is intaken by a pump.

SUMMARY OF THE INVENTION

An object of the present invention is to provide a means for influencing the temperature having a comparatively far better efficiency and an especially space-saving construction.

This object is basically achieved according to the present invention by a means comprising at least one temperature-influencing element located within the medium-carrying line section and supplied with energy via a connecting means located in the wall of the line section. Losses are prevented which arise in the prior art by heat transfers between the temperature-influencing elements located on the outside wall of the line section to the vicinity, even if there is complex external insulation over the elements. Also, efficiency is very greatly improved as a result of the direct heat transfer between the medium and the elements placed in its flow path. In the means of the present invention, the necessity is obviated of awkwardly shaped external insulation surrounding the line section and the elements located outside on it. The means of the present invention is characterized by an especially compact, space-saving construction, so that the means can also be used without difficulty in mechanical systems where narrowed space conditions prevail and little installation space is available.

Preferably, at least one temperature-influencing element is located within an element unit, and the connecting means forms a holding device for fixing the position of the element unit.

Where a means for raising the temperature of the pertinent media is provided and the element unit is accordingly a heating unit containing at least one heating element activated by electrical energy, for especially advantageous exemplary embodiments, the heating unit has at least one heating strip extending in the longitudinal direction of the line section and intended as a heating element.

Heating strips in the form of self-regulating surface heating strips are known and are commercially available. The self-regulating property enables use of such heating strips without the need for electrical control means. Since these heating strips are available in any desired length, these heating strips are especially well suited for use in the means of the present invention.

In heating strips, even if they have a multilayer structure in the conventional manner and an outside protective jacket of polyolefin, in conjunction with certain media (oils) over very long operating intervals, the protective jacket of the heating strips can be adversely affected. In an especially advantageous exemplary embodiment of the present invention, the heating unit contains at least one heating strip with a shell surrounding at least one heating strip and sealing it against the medium.

This shell can advantageously be a corrugated tube of high-quality steel which is welded tight on one end and is connected to the connecting means on its other end.

The arrangement can be made such that the connecting means has a pipe union which is located on one end region of the line section and through which the assigned end of the corrugated tube extends.

This end of the corrugated tube can be welded to a sleeve-like adapter which with the interposition of a seal arrangement can be screwed to the outer end area of the pipe union which can form a penetration for a connecting cable for power supply of at least one heating strip located in the corrugated tube.

In the corrugated tube, preferably two heating strips extend longitudinally and are held spaced apart from one another by a separating element extending between them. The thermal influence of the heating strips on one another and thus any adverse effect on the self-regulating property of each individual heating strip are then avoided.

In exemplary embodiments in which the line section can be an oil intake tube, therefore a compound with nonmetallic walls, the arrangement is preferably made such that the line section has a metallic elbow bent relative to the longitudinal axis of the intake tube and connected to the oil intake tube. On the elbow, a pipe union is provided. The pipe union preferably extends in the direction of the longitudinal axis of the intake tube, so that the corrugated tube screwed to the pipe union is fixed in the position extending in the direction of the longitudinal axis of the intake tube.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure.

DETAILED DESCRIPTION OF THE INVENTION

The present invention is explained below with reference to the drawings illustrating one exemplary embodiment in which a means increases the temperature of the lubricating oil flowing through the intake tube 1. The nonmetallic intake tube 1 made in the conventional manner is connected on one end by a connecting fitting 3 to a mechanism (not shown). On the opposite end, intake tube 1 is connected to a metallic pipe elbow 5 bent at a right angle relative to the longitudinal axis 7 of the intake tube 1. Pipe elbow 5 leads to a pump (not shown) that sucks the lubricating oil out of the mechanism and forms part of a pertinent lubricant circuit.

Figure 4:
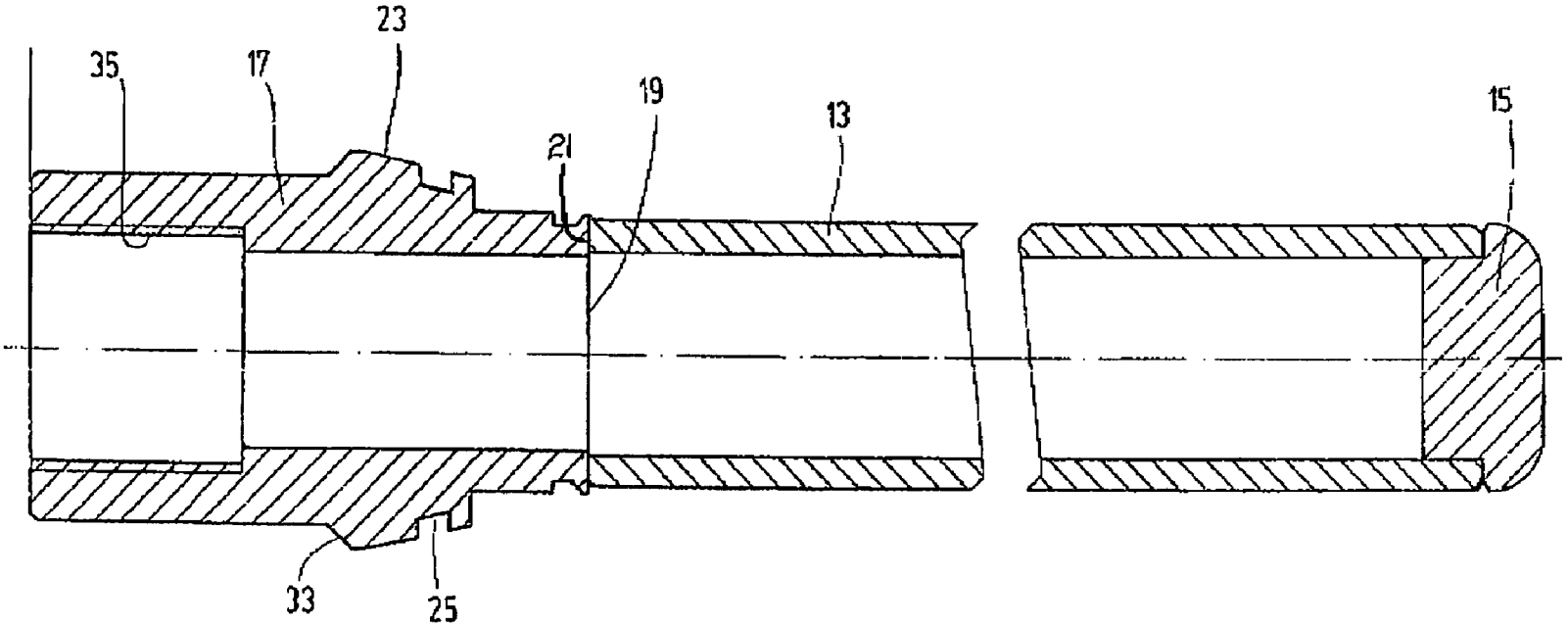
FIG. 4 is a side elevational view in section of the shell only of the heating unit, drawn isolated and enlarged compared to FIG. 1 and according to one practical embodiment of the present invention.

As access to the line section formed by the intake tube 1 and the elbow 5, a pipe union 9 is welded to the elbow 5 such that it forms a passage with an axis which coincides with the longitudinal axis 7 of the intake tube 1. An elongated heating unit 11 extends through the passage formed by the pipe union 9 into the interior of the intake tube 1 along the axis 7 into the vicinity of the end-side connecting fitting 3. The heating unit 11 has a corrugated tube 13 of conventional design of high grade steel as a shell which seals the interior of the heating unit 11 fluid-tight against the surrounding lubricating oil. The corrugated tube 13, shown separately and enlarged in FIG. 4, is welded fluid-tight to the closure body 15 on the tube right end, as viewed in the drawings. On the other incoming end 21 assigned to the pipe union 9, the corrugated tube 13 is welded to a sleeve-like adapter 17 at the weld 19 (FIG. 4). In a longitudinal section placed between the adapter outer end and the weld 19, the adapter 17 has a thickened area with a conical surface 23 which is tilted or tapered to the inside in the direction to the weld 19 and with an annular groove 25 made for a gasket which is not shown in FIG. 4.

Figure 1:
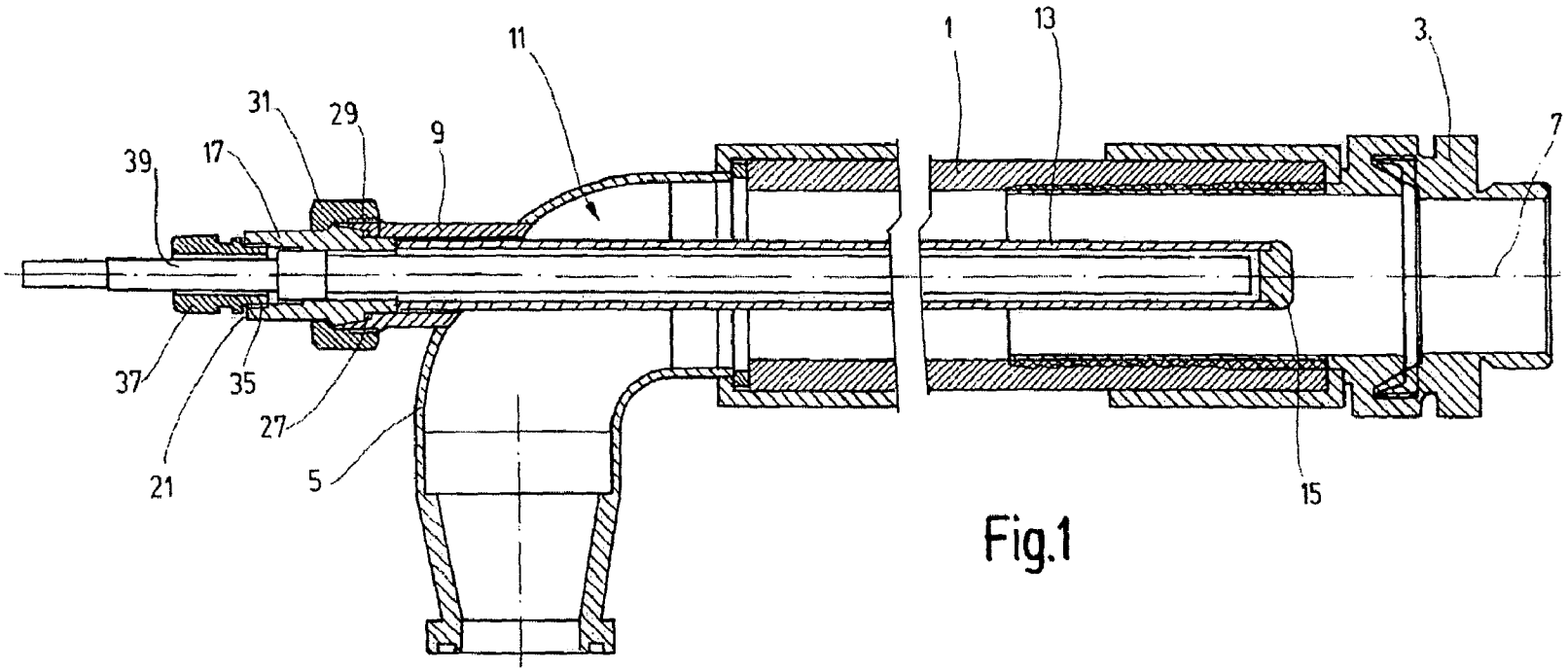
FIG. 1 is a shortened, side elevational view in section of a means according to one exemplary embodiment of the present invention for increasing the temperature of the lubricating oil flowing through an oil intake tube.

FIG. 1 shows the heating unit 11 in the installed state. The corrugated tube 13 extends into the pipe union 9 forming a holder for the heating unit 11, i.e., with the union inside wall aligning the corrugated tube 13 so that it extends along the axis 7 in the intake tube 1. In the outside edge area, the pipe union 9 has a conical surface complementary to the conical surface 23 of the adapter 17. In the installed state, the pipe union conical surface is adjoined by the conical surface 23 of the adapter 17, and is sealed thereon via the gasket 27 (FIG. 1) which sits in the annular groove 25. The outer end section of the pipe union 9 has an outside thread 29 to screw the adapter to the pipe union by a union nut 31 supported on the annular shoulder 33 (FIG. 4) of the adapter 17.

As is best shown in FIG. 4, the adapter 17 on its open end 21 has an inner widened area with an inside thread 35 into which a hollow threaded plug 37 can be screwed. Plug 37 is part of the penetration of an electrical connecting cable in the form of a so-called oil connection 39. Electrical power supply of the heating elements located in the heating unit 11 within the corrugated tube 13 takes place via this connection 39.

Figure 2:
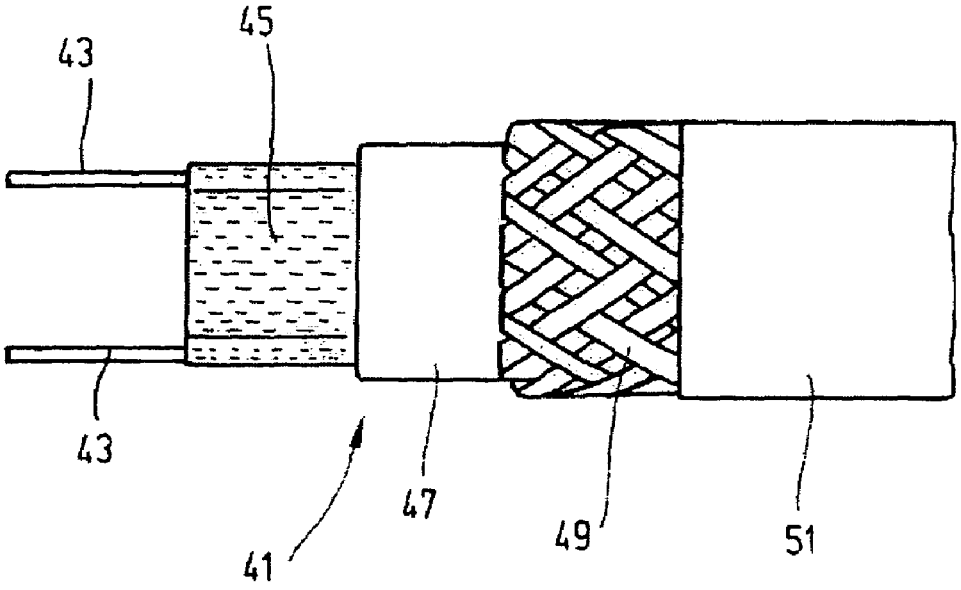
FIG. 2 is an enlarged side elevational view with portions broken away of a heating strip for use in the means of FIG. 1.
Figure 3:
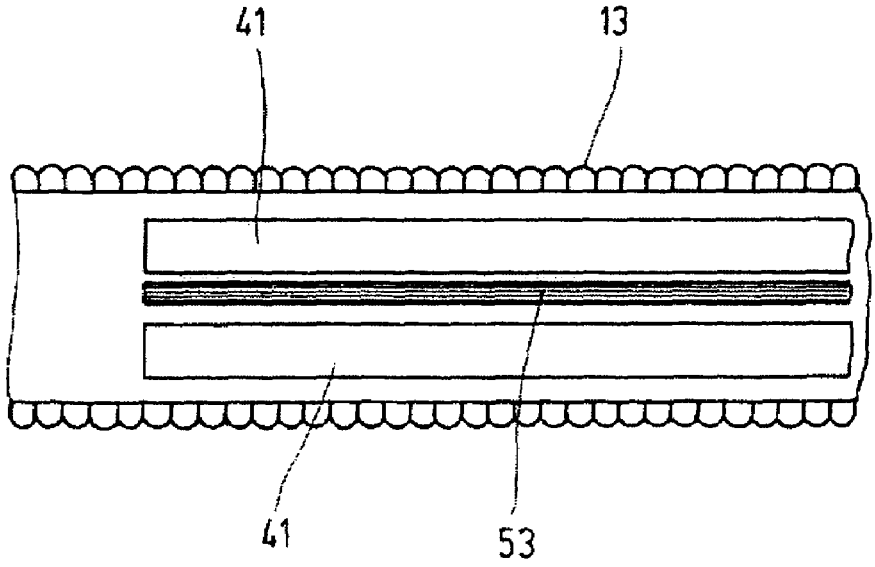
FIG. 3 is a highly schematically simplified, side elevational view of the positioning of the two heating strips, drawn on a smaller scale than FIG. 2, within the shell of the heating unit of FIG. 1.

Details of the structure and the arrangement of the heating elements are illustrated in FIGS. 2 and 3. FIG. 2 shows the structure of a heating strip 41 is intended for use in the present invention. In the conventional manner, heating strip 41 has two electrical leads or conductors 43 extending at a distance from one another. Strip-like material 45 is between leads 43 forming a self-regulating resistance element. As is known, the electrical resistance of the material 45 has a positive temperature coefficient. With rising temperature of the material 45, the strength or amount of current flowing between the conductors 43 decreases for the self-limitation of the heating action to occur. Since heating strips 41 are available in any length, the power and temperature ranges desired at the time can be accommodated without the need for control means.

As can be taken from FIG. 2, the heating strip 41 is made such that the self-regulating material 45 is surrounded by an electrical insulating jacket 47. The insulating jacket in turn is enclosed by a protective braid 49 of galvanized copper litz wire. This braid is used for grounding (protective conductor) of the heating strip, protects individuals according to VDE (Association of German Electrical Engineers) Standards, and offers additional mechanical protection. An outside jacket 51 of polyolefin forms the outer termination of the structure.

In this example, the heating unit 11 has two heating strips 41 located and extending longitudinally within the corrugated tube 13. As the outline sketch from FIG. 3 illustrates, the heating strips are thermally insulated from one another by a joint strip 53 extending longitudinally between them. This thermal decoupling of the heating strips 41 prevents the temperatures of the two strips from being mutually brought to bear. Thus, the intensity of the heating output, a function of the temperature of the surrounding medium, is not influenced by the other heating strip. The use of heating strips 41 is advantageous in several respects. Thus, based on the self-limitation of power, use without a temperature limiter is possible. The heating strips 41 can be cut off in any length to adapt to the pertinent conditions of use by the parallel current supply.

A joint strip 53 in the form of precompressed polyurethane foam has proven especially effective as the separating element between the heating strips 41. In particular, it can be an open-cell polyurethane soft foam, impregnated with a synthetic resin made flame-retardant.

While one embodiment has been chosen to illustrate the invention, it will be understood by those skilled in the art that various changes and modifications can be made therein without departing from the scope of the invention as defined in the appended claims.

What is claimed is:

1. A temperature influencer for flowable media, comprising:

a flow line for conveying a flowable medium;

at least one temperature element inside a line section of said flow line and in a flow path of the medium for changing medium temperature and activated by supplying energy;

a connection located in said line section for supplying energy to said temperature element, and having a pipe union located at a first end area of said line section;

a shell surrounding said temperature element and sealing said temperature element from the medium, said shell being a corrugated tube of high-quality steel welded closed at a first end thereof and having an opposite second end thereof connected to and received in said pipe union to hold and position said corrugated tube in said line section; and a sleeve adapter welded to said second end of said corrugated tube and coupled by a thread on an outer end area of said pipe union with a seal interposed therebetween.

2. A temperature influencer according to claim 1 wherein said temperature element comprises at least one heating element activated by electrical energy.

3. A temperature influencer according to claim 2 wherein said heating element comprises at least a first heating strip extending longitudinally in said line section.

4. A temperature influencer according to claim 3 wherein a connecting cable extends through said sleeve adapter for supplying power to said first heating strip.

5. A temperature influencer according to claim 3 wherein said heating element comprises a second heating strip extending with said first heating strip longitudinally inside said corrugated tube; and a separating element extends longitudinally between and holds said first and second heating strips apart.

6. A temperature influencer according to claim 1 wherein said line section comprises an oil intake tube and a metallic elbow bent relative to a longitudinal axis of said intake tube connected to said intake tube, said pipe union being mounted on said elbow, said corrugated tube and said temperature element extending through said elbow and into said intake tube.

7. A temperature influencer according to claim 6 wherein said pipe union extends in a direction of said longitudinal axis of said intake tube.

8. A temperature influencer according to claim 1 wherein the medium is lubricating oil that flows through the line section.

9. A temperature influencer according to claim 1 wherein said corrugated tube has a closure body welded to and closing said first end thereof.

10. A temperature influencer according to claim 1 wherein said sleeve adapter and said pipe union comprise mating tapered portions.

11. A temperature influencer according to claim 1 wherein said sleeve adapter comprises a tapered shoulder on an outer surface thereof; and a thread member surrounding said sleeve adapter abuts said tapered shoulder and threadedly engages said pipe union.

12. A temperature influencer according to claim 1 wherein said corrugated tube has a closure body welded to and closing said first end thereof;

said sleeve adapter and said pipe union comprise meeting tapered portions;

said sleeve adapter comprises a tapered shoulder on an outer surface thereof; and a thread member surrounding said sleeve adapter abuts said tapered shoulder and threadedly engages said pipe union.

* * * * *